US007001324B2

(12) United States Patent
Hensley et al.

(10) Patent No.: US 7,001,324 B2
(45) Date of Patent: Feb. 21, 2006

(54) METHOD OF RETROFITTING A DECANTING CENTRIFUGE

(75) Inventors: Gary L. Hensley, Kingwood, TX (US); Lee Hilpert, Livingston, TX (US)

(73) Assignee: Hutchison Hayes, L. P., Houston, TX (US)

( * ) Notice: Subject to any disclaimer, the term of this patent is extended or adjusted under 35 U.S.C. 154(b) by 128 days.

(21) Appl. No.: 10/751,774

(22) Filed: Jan. 5, 2004

(65) Prior Publication Data

US 2004/0167005 A1 Aug. 26, 2004

Related U.S. Application Data

(60) Provisional application No. 60/438,650, filed on Jan. 8, 2003.

(51) Int. Cl.
*B04B 1/20* (2006.01)

(52) U.S. Cl. ..... 494/53

(58) Field of Classification Search ..... 494/37, 494/50–55; 210/380.1, 380.3
See application file for complete search history.

(56) References Cited

U.S. PATENT DOCUMENTS 3,568,919 A * 3/1971 Nielsen ..... 494/53
3,568,920 A * 3/1971 Nielsen ..... 494/53
4,059,223 A * 11/1977 Lewis ..... 29/426.5
4,142,669 A * 3/1979 Burlet ..... 494/53
6,296,125 B1 * 10/2001 Dudley ..... 210/380.1
6,908,423 B1 * 6/2005 Hruschka et al. ..... 494/37
2004/0058796 A1 * 3/2004 Feldkamp et al. ..... 494/56
2004/0167005 A1 * 8/2004 Hensley et al. ..... 494/53
2004/0176234 A1 * 9/2004 Leung ..... 494/37

FOREIGN PATENT DOCUMENTS

JP 54-14072 * 2/1979
JP 54-14073 * 2/1979
JP 54-159778 * 12/1979

* cited by examiner

*Primary Examiner*—Charles E. Cooley
(74) *Attorney, Agent, or Firm*—Law Office of Tim Cook P.C.

(57) ABSTRACT

A method of retrofitting a centrifuge is provided. The method includes disassembling a known centrifuge and replacing a bowl section of the centrifuge outer body with a longer bowl section. The method further comprises replacing the conical beach section with a shorter beach section, i.e. a beach section having a greater slope. The screw conveyor is replaced with another screw conveyor having outlet nozzles adapted to impart rotational movement to the inlet feed. The retrofitted centrifuge provides enhanced performance through an additional length of cylindrical section, thereby making the clarification length longer, and improving the effectiveness of the centrifuge in removing solids from the inlet feed. The retrofitted centrifuge preferably remains mounted to the same pedestal as the centrifuge prior to retrofit.

5 Claims, 2 Drawing Sheets

METHOD OF RETROFITTING A DECANTING CENTRIFUGE

This application claims the benefit of U.S. Provisional Patent Application Ser. No. 60/438,650 filed Jan. 8, 2003.

FIELD OF THE INVENTION

The present invention relates generally to the field of decanting centrifugal separators, and, more particularly, to a method of retrofitting a decanting centrifuge to extend the useful life of such a centrifuge while substantially improving its performance.

BACKGROUND OF THE INVENTION

A decanting centrifuge is commonly used for separating solid matter from a solids-laden liquid. For example, drilling mud with solids entrained therein must be effectively cleaned so that the drilling mud can be recycled. For another example, many manufacturing and food processing systems use vast quantities of water. In such systems, the water picks up solid waste matter which must be removed from the water before it can be discharged, whether it is into the environment or into storage. Decanter centrifuges have proved to be effective and efficient in carrying out this function of removing the solids from the recyclable liquid.

Generally, a decanter centrifuge comprises a cylindrical or frustoconical bowl rotating in one direction and at a particular although variable speed, and a screw conveyor rotating in the same direction but at a different speed. The difference in the speeds of the bowl and the screw conveyor is commonly known in the art as the differential speed.

In a well known decanting centrifuge structure, liquid which is to be clarified enters an inlet to the centrifuge where it is brought up to rotational speed around the interior surface of the bowl. Heavier elements, i.e. solids, are brought to the interior surface of the bowl by centrifugal force (furthest from the axis of rotation), while lighter elements, i.e. water or drilling fluid, remains closer to the axis of rotation of the centrifuge. The screw conveyor, rotating at a speed slightly slower than that of the bowl, conveys the solids toward a beach in a conical portion of the bowl.

No matter how well a piece of machinery is built, eventually it will wear out. Within a limited number of hours of high speed operation, a centrifuge likewise will require maintenance and eventually will have to be replaced because of worn parts. However, even with much of a centrifuge at the end of its useful life, major and costly portions of the centrifuge have substantial useful life remaining. This means that a large, expensive piece of machinery is often scrapped because only part of the machine is worn out.

Also, with improvements in technology, some machinery is replaced simply because, although major portions of the machines have useful lifetime left in them, when major overhaul is called for, it makes good economic sense to upgrade the machinery. Such full scale machinery replacement is often a major expenditure and is not undertaken lightly.

Thus, there remains a need for a method of retrofitting a centrifuge to extend the useful lifetime of the machine, while simultaneously upgrading the performance of the machine.

SUMMARY OF THE INVENTION

The present invention addresses this need in the art by providing a method of retrofitting a known centrifuge. The known centrifuge includes a bowl formed of tandem sections and this feature is used to advantage in the method of the present invention to alter the configuration of the beach. This step in the method requires modification to the bowl and screw conveyor, and this modification must be accomplished within the constraint of a longitudinal distance between pedestals on which the existing machine is mounted.

The known centrifuge further includes a liquid inlet volume within the screw conveyor which simply allows liquid friction to bring the inlet liquid up to rotational speed of the bowl. This feature of the known centrifuge is improved by providing a series of radially oriented nozzles to impart rotational speed to the incoming, solids-laden liquid.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
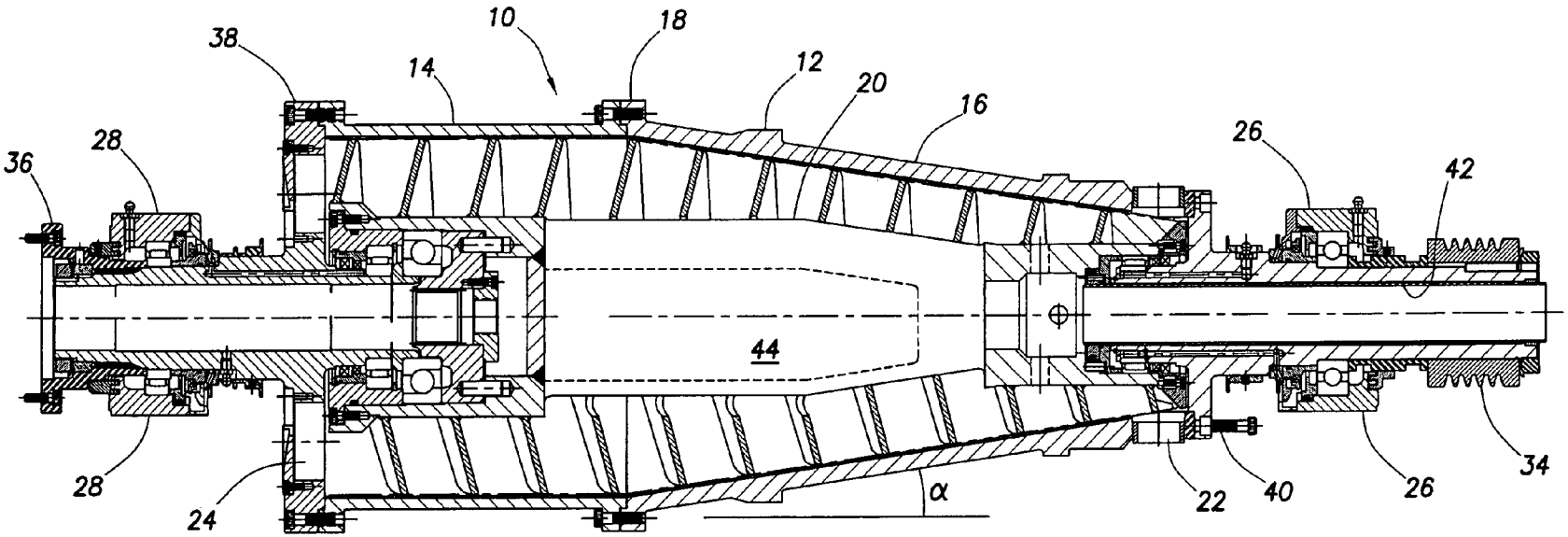
FIG. 1 (PRIOR ART)
FIG. 1 is a side section view of known decanting centrifuge which is retrofitted and upgraded in carrying out the present invention.

FIG. 1 depicts a decanting centrifuge 10 which is to be retrofitted by the method of the present invention. The centrifuge 10 comprises an outer body 12 which includes a bowl section 14 and a conical section 16, joined together at a flanged joint 18. The bowl section defines a slope angle of $\alpha$. In practice, a plurality of bowl sections 14 are provided, thereby enabling a bowl section of a selectable length.

Enclosed within the outer body 12 is a screw conveyor 20, coaxial with the outer body for rotation therein. The outer radial profile of the screw conveyor 20 is in close proximity with the inner surface of the outer body, both the bowl section and the conical section, to convey solids toward the right as viewed in FIG. 1, and out through a solids discharge 22. Liquids are discharged through a liquids discharge port 24.

The centrifuge is supported on the solids end by a solids end pillow block 26 and on the liquids end by a liquids end pillow block 28. The pillow block 26 is supported on a pedestal 30 and the pillow block 28 is supported on a pedestal 32, shown in FIG. 2. A drive pulley 34 couples the centrifuge 10 to a prime mover (not shown), which drives both the outer body 12 and the screw conveyor. The difference in rotational speed between the outer body 12 and the screw conveyor is provided by a transmission (not shown), coupled to the machine at a gear flange 36 in a manner well known in the art.

The left hand end of the centrifuge is closed off with a liquids hub 38 and at the right hand end with a solids hub 40. An inlet line 42 penetrates the solids hub 40 to introduce a solids laden slurry into the centrifuge 10. The solids laden slurry passes from the inlet line 42 into an inlet plenum 44, where it is forced radially outwardly by the flow of more liquid behind it and in part by fluid friction. Note that no structural member of the centrifuge in the inlet plenum imparts rotational movement to the slurry to be clarified. At this point, once the liquid is caught up in the screw conveyor, rotational movement is imparted, and heavier solids are moved by centrifugal force to the interior surface of the outer body, and lighter liquids settle on top of the solids. The screw conveyor moves the solids to the right to the conical section, which defines the beach, while liquids are discharged to the left.

The structure of the centrifuge 10 just described was designed for a specific throughput of solids laden liquid, and has proven to be successful for certain applications. In fact, many such machines are currently installed and operating in industry. However, many have reached the normal end of their life cycle, and machines having superior performance are now available. So, even though such machines have value, as they approach overhaul they are being replaced. What is really needed is a method of retrofitting such machines to improve their capability, while salvaging the expensive portions of the machines still having substantial working life remaining. The present invention provides such a method.

Figure 2:
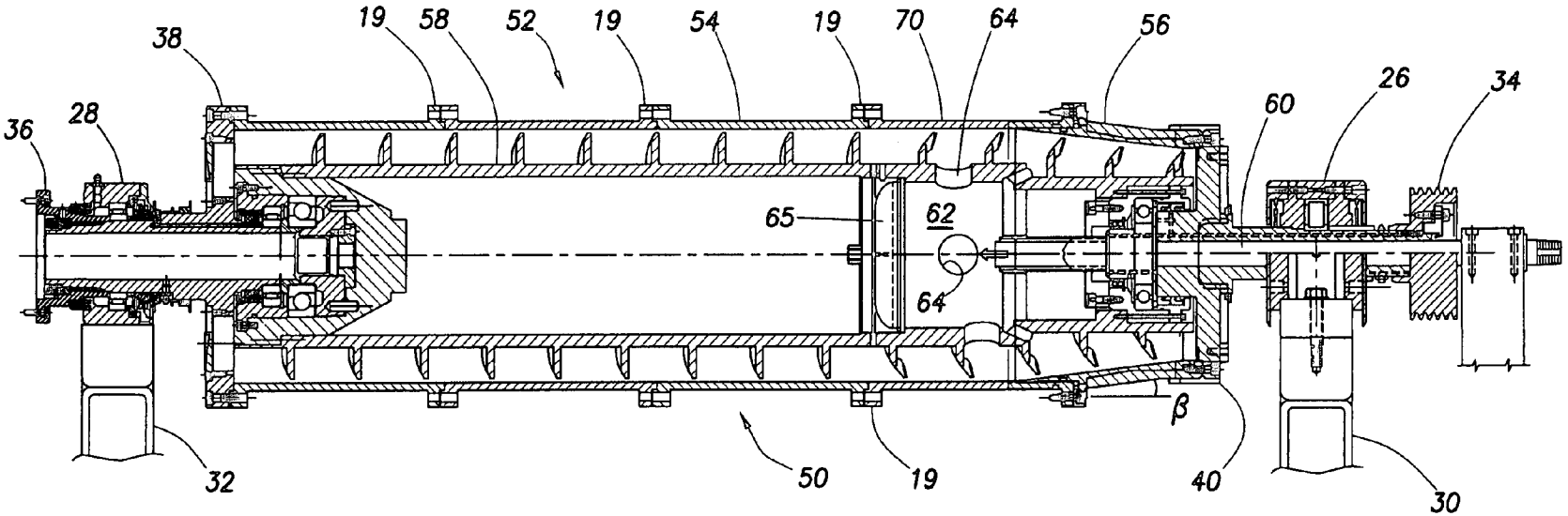
FIG. 2 is a side section view of the decanting centrifuge after retrofit.

FIG. 2 depicts a centrifuge 50 after retrofit in accordance with the present invention, having completed a retrofit of the centrifuge 10 of FIG. 1. In FIG. 2, like components are given like numerals.

The centrifuge 50 includes an outer body 52, comprising a bowl section 54 and a conical section 56. Note that the conical section 56 defines a much shorter axial length, and therefore also defines a slope $\beta$, which is greater than the slope $\alpha$, of the centrifuge 10. Note also that the screw conveyor 20 has been replaced with a screw conveyor 58. The screw conveyor 58 defines a longer axial length and a shorter frustoconical portion to conform to the interior surface of the outer body. Also, the screw conveyor 20 defines an inlet line 60, which directs the inlet feed of solids laden liquid into an inlet plenum 62. The inlet plenum 62 comprises only the extreme end of the cylindrical portion of the screw conveyor, and is blocked off from the remainder of the cylindrical portion by a wall 65. The liquid entering the inlet plenum 62 is forced out through nozzles 64, which also impart rotational motion to the feed liquid as it enters the region between the outer body and the screw conveyor.

While the bowl section 14 of the centrifuge depicted in FIG. 1 comprises a single section, the section may be formed of discrete section portions coupled together at flanges 19, like the flange coupling 18. In fact, the bowl section commonly includes three such sections. However, in carrying out the retrofit method of the invention, an additional cylindrical section 70 is added. This additional section provides the benefit of shortening the length between the end of the section 70 at the solids hub 40. This reduces the length of travel that the conical portion of the screw conveyor must transport solids which have been removed from the solids laden inlet feed.

The modification of the structure of FIG. 1 to that of FIG. 2 provides an additional advantage. The length of the decanting centrifuge between the point at which the inlet feed enters the region between the screw conveyor and the interior surface of the outer body is known as the "clarification length." The centrifuge 10 of FIG. 1 does not have a well defined clarification length because the inlet feed enters the subject region all along the inlet plenum 44. At best, the clarification length is roughly the length of the cylindrical portion of the centrifuge. In contrast, the centrifuge 50 provides an additional length of cylindrical section, thereby making the clarification length longer, and improving the effectiveness of the centrifuge in removing solids from the inlet feed.

Thus, the method of the present invention comprises disassembling the centrifuge illustrated in FIG. 1 as if to perform an overhaul. The overhaul would routinely include such matters and replacing bearings, wear inserts, and the like which suffer accelerated wear during routine use of the centrifuge. Once the centrifuge is apart, the bowl section of the outer body is extended by installing the bowl section 54. The screw conveyor 20 is removed and replaced with the screw conveyor 58, defining a longer cylindrical portion and having outlet nozzles adapted to impart rotational movement to the inlet feed. Then, a new, higher angle slope conical section 56 is installed.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A method of retrofitting a decanting centrifuge, comprising the steps of:

a. replacing a bowl section of the centrifuge outer body with a longer bowl section;

b. replacing a conical section of the centrifuge outer body with a conical section defining a greater slope angle; and c. replacing a screw conveyor of the centrifuge with a screw conveyor having nozzles therein adapted to impart rotation movement to feed liquid.

2. The method of claim 1, wherein the centrifuge is supported on a pair of spaced apart pedestals.

3. A method of retrofitting a decanting centrifuge, comprising the steps of:

a. adding a segment of a bowl section of the centrifuge outer body, thereby making the bowl section longer;

b. replacing a conical section of the centrifuge outer body with a shorter conical section, wherein the combined length of the added segment of the bowl section and the shorter conical section is substantially the same as the replaced conical section; and c. replacing a screw conveyor of the centrifuge with a screw conveyor having means therein adapted to impart rotation movement to a slurry input to the centrifuge.

4. The method of claim 3, wherein the centrifuge is supported on a pair of spaced apart pedestals.

5. The method of claim 3, wherein the means to impart rotation movement to feed liquid comprises a plurality of nozzles.

* * * * *